US005947537A

United States Patent [19]

Aigner et al.

[11] Patent Number: 5,947,537

[45] Date of Patent: Sep. 7, 1999

[54] SPRING BIASED HANDLE CATCH

[75] Inventors: Helmut R. Aigner; Cliff W. Allen, Jr.; Frederick M. Hensley; Troy A. Dalsing; Melinda T. Neligon, all of Colorado Springs, Colo.

[73] Assignee: Schlage Lock Company, San Francisco, Calif.

[21] Appl. No.: 08/976,809

[22] Filed: Nov. 24, 1997

[51] Int. Cl.[6] ..... E05B 3/00

[52] U.S. Cl. ..... 292/352; 292/348; 292/353; 403/327

[58] Field of Search ..... 292/359, 348, 292/349, 353, 336.3, 352; 403/327; 267/158

[56] References Cited

U.S. PATENT DOCUMENTS

| | | | |
|---|---|---|---|
| 473,988 | 5/1892 | Whipple | 292/348 |
| 2,098,868 | 11/1937 | Grimmond | 292/353 |
| 2,660,466 | 11/1953 | Cerf, Jr. | 292/352 |
| 2,672,041 | 3/1954 | Heyer | 70/223 |
| 2,676,050 | 4/1954 | Nichols | 292/348 |
| 2,778,667 | 1/1957 | Young | 292/352 |
| 3,128,115 | 4/1964 | Patriquin et al. | 292/336.3 |
| 3,196,644 | 7/1965 | Russell et al. | 70/224 |
| 3,196,645 | 7/1965 | Russell | 70/224 |
| 3,477,309 | 11/1969 | Sprecher | 292/353 |
| 3,582,121 | 6/1971 | Rollins | 292/170 |
| 3,779,590 | 12/1973 | Sanders et al. | 292/336.3 |
| 3,955,387 | 5/1976 | Best et al. | 70/224 |
| 4,342,478 | 8/1982 | Foshee | 292/352 |
| 4,428,570 | 1/1984 | Foshee et al. | 267/164 |
| 4,437,695 | 3/1984 | Foshee | 292/352 |

FOREIGN PATENT DOCUMENTS

| | | | |
|---|---|---|---|
| 1119714 | 12/1961 | Germany | 292/353 |
| 119714 | 12/1961 | Germany . | |

*Primary Examiner*—Suzanne Dino Barrett
*Assistant Examiner*—Teri Pham
*Attorney, Agent, or Firm*—Michael H. Minns

[57] ABSTRACT

A knob catch for securing a knob or lever to the driving spindle of a door lock. The knob catch is constructed of a base with a centered odd shaped hole. The hole is made in such a way that the knob or lever cannot be removed when the locking device is in the locked position using a key operated cylinder with a flat locking bar. A tongue portion of the knob catch rises above the base and fits into the knob or lever and keeps the knob or lever from being removed. In the front side of this tongue is an angular surface which permits the knob or lever to be slid over the top of the knob catch until the knob catch tongue and an aperture in the knob or lever align allowing the tongue to be spring biased into the aperture to secure the knob or lever. There are two springs attached to the knob catch to bias the tongue into engagement with the knob or lever aperture.

10 Claims, 4 Drawing Sheets

SPRING BIASED HANDLE CATCH

BACKGROUND OF THE INVENTION

This invention relates generally to door lock assemblies and more particularly to a spring catch for attaching removable levers and knobs to a lock chassis.

In locksets, removable knobs and levers are usually attached by a steel plate or catch. The catch is positioned within a steel sleeve, commonly referred to as a spindle, and oriented perpendicular to the longitudinal axis of the spindle. The catch is spring loaded (or biased in one direction) such that a leading edge of the catch projects through an opening in the spindle and extends beyond the outer diameter of the spindle.

To attach the knob to the spindle, the catch is pressed inwardly into the spindle (under spring load) and the knob is inserted over the spindle until a slot in the knob is aligned with the catch. In a free condition and with the force of the spring, an edge of the catch extends back out of the spindle and engages the slot in the knob. This edge, when engaged into the knob slot, axially retains the knob to the lock chassis. Depressing the catch allows removal of the knob.

Lock manufacturers use a variety of designs to achieve this spring load that provides the bias to the catch. One common design uses a section of straight music wire that is first "woven" through three holes in the spindle and fed through a hole in the catch and then finally detented or deformed such that it exerts a spring load to the catch. Another design is illustrated in U.S. Pat. No. 4,342,478 which discloses a wire form spring that exerts a load from the inside diameter of the spindle to the catch.

One problem with known catch designs is the complex operations necessary to install the catch, either during manufacturing or in the field in the event the wire breaks. Frequently, these known designs do not lend themselves to automation.

The foregoing illustrates limitations known to exist in present handle catches. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a handle connector mechanism for connecting a door handle to a tubular sleeve comprising: a connector mounted for movement radially of the tubular sleeve to a door handle connecting position, the connector comprising a flat plate-like member having a tongue extending in a first direction from the flat plate-like member and two spring members attached to the flat plate-like member proximate the tongue.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
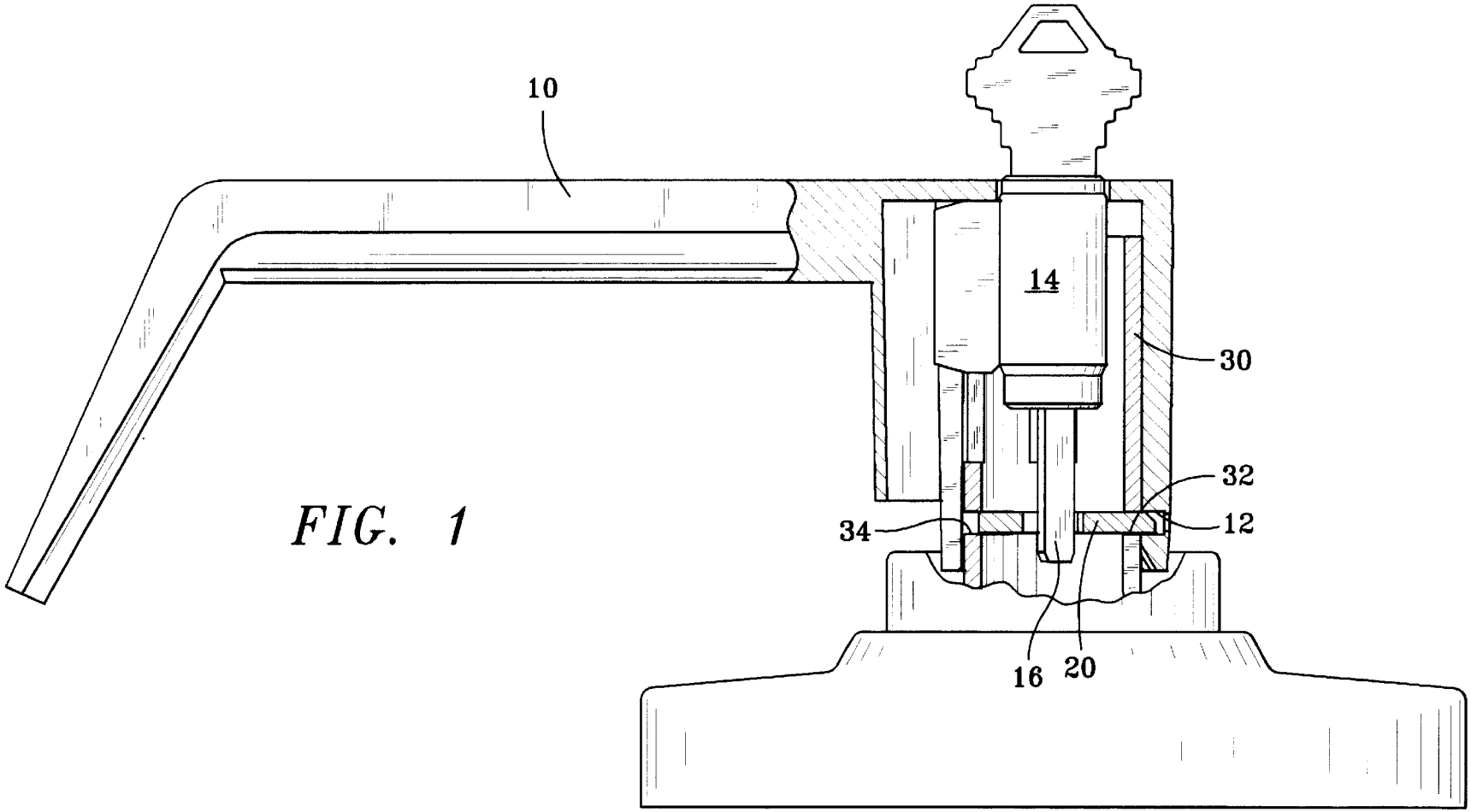
FIG. 1 is a cross-section of a handle assembly illustrating the handle catch of the present invention.
Figure 2:
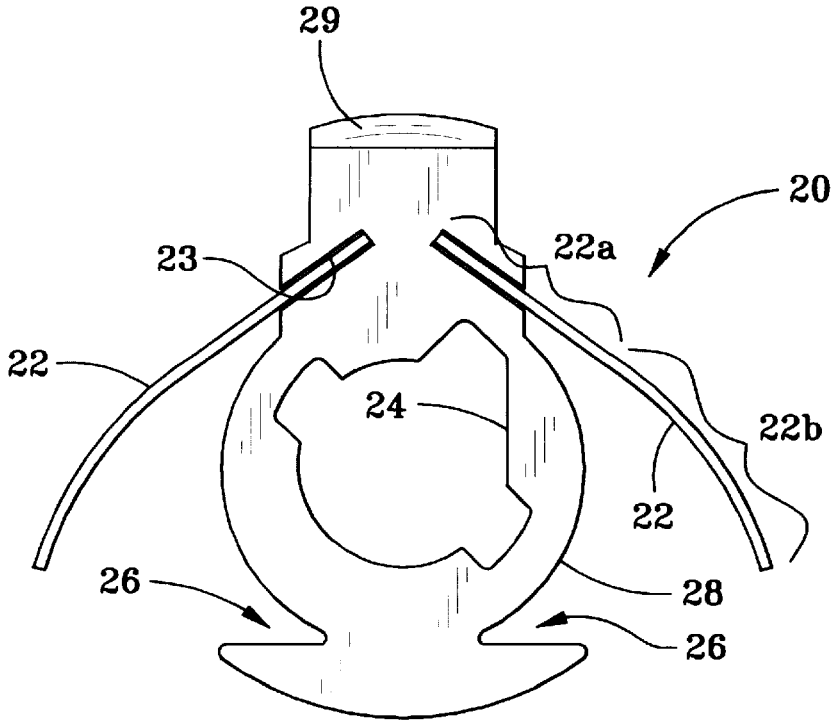
FIG. 2 is a plan view of the handle catch shown in FIG. 1.

FIG. 1 shows a cross-section of part of lockset illustrating a handle 10, either a lever (as shown) or a knob, attached to a tubular lock spindle 30 with the handle catch 20 of the present invention being used to attach either the lever 10 or a knob to the tubular spindle 30. The lever 10 contains a catch slot 12 for accepting a catch tongue 29 of the handle catch 20. The catch tongue 29 extends through a corresponding spindle catch slot 32 in the spindle 30 and into the catch slot 12.

Figure 3:
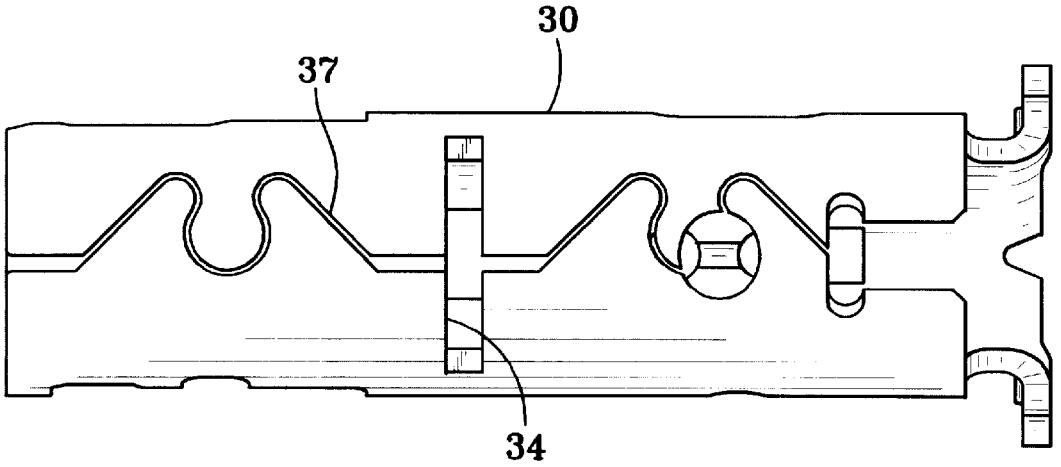
FIG. 3 is a plan view of a commonly used lock spindle.
Figure 4:
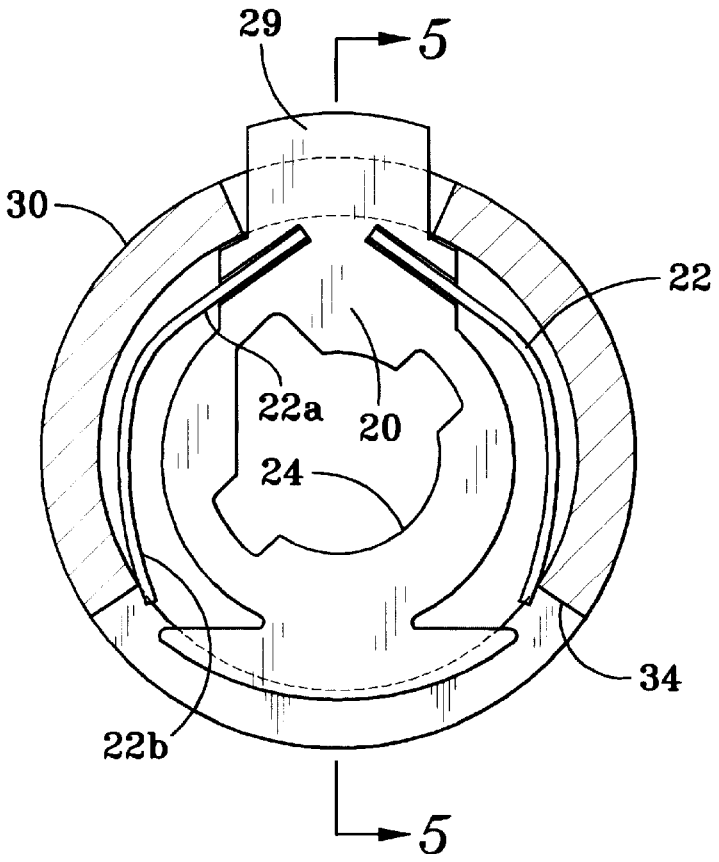
FIG. 4 is a cross-section taken along line 5—5 of FIG. 5 showing the handle catch installed in the spindle.
Figure 5:
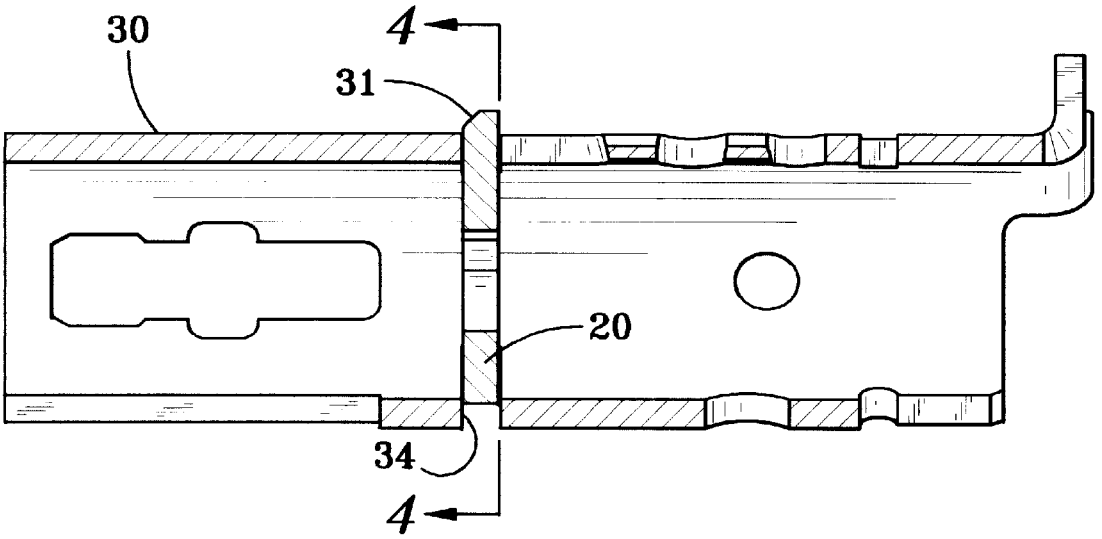
FIG. 5 is a cross-section taken along line 4—4 of FIG. 4 also showing the handle catch installed in the spindle.

FIG. 3 illustrates a typical spindle 30 having a joint seam 37. The handle catch 20 is inserted through installation slot 34 with the catch tongue 29 extending through spindle catch slot 32. The spindle 30 may be formed by rolling or cut with a seamless laser. Preferably, the handle catch 20 is used with a seamless laser cut spindle 30, illustrated in FIGS. 1 and 4 through 7.

The handle catch 20 is self contained, i.e., it requires no further motive or biasing force to snap into place other than those parts which are integral in its construction. As shown in the FIGURES, the handle catch 20 is constructed of a base or flat plate-like catch body 28 with a centered odd shaped hole or aperture 24. The aperture 24 is shaped such that the lever 10 can not be removed (i.e., the handle catch 20 can not be depressed to release the handle 10) when the locking device is in the locked position using a key operated cylinder 14 having a flat locking bar 16 extending through the aperture 24.

Extending from the catch body 28 is a tongue 29 which fits into the handle slot 12. On the front side of the tongue 29, towards the lever 10, is an angular surface 31 that permits the lever 10 to be slid over the top of the catch 20 to the point that the catch 20 and the catch slot 12 align themselves where the catch 20 is biased by springs into engagement with the slot 12. Extending from the catch 20, in the region where the tongue 29 extends from the catch body 28 are two springs 22. Preferably, the springs are formed from 302 stainless steel which was chosen for its non-rusting and spring constant characteristics. Each spring 22 consists of a straight portion 22*a* attached to the catch 20 and a curved portion 22*b*. The combination of the straight portion 22*a* and curved portion 22*b* increases the spring force on the inside of the spindle 30. Preferably, spring slots 23 are EDM'd (electrical discharge machined) in the catch 20. After the springs 22 are inserted into the slots 23, they are laser welded (preferably on one side only) to the catch 20. The spring resistance between the spindle 30 and the handle catch 20 created by the springs 22 coming in contact with the inside cylindrical walls of the spindle 30 prevent accidental disengagement of the catch 20 from the lever 10 and creates a situation where the handle catch 20 must be deliberately disengaged from the lever 10 to remove the lever 10 from the spindle 30.

Figure 6:
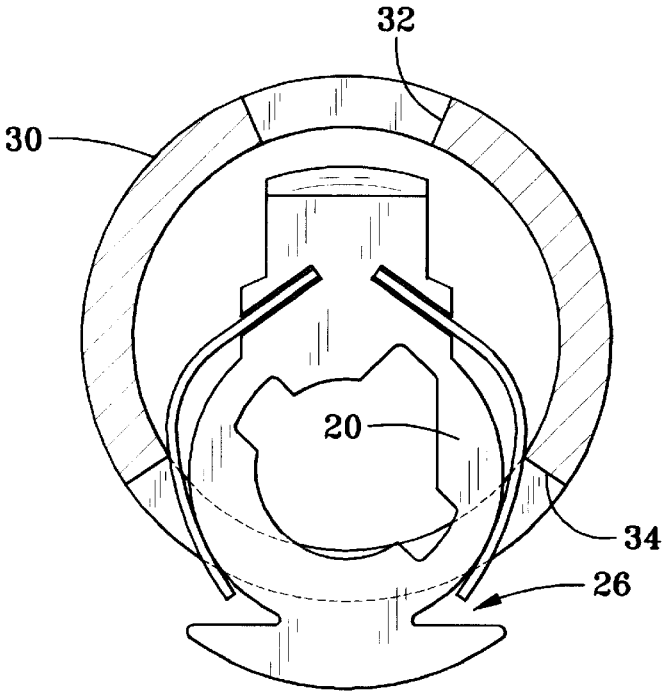
FIG. 6 is a cross-sectional view showing the handle catch being inserted into the spindle.
Figure 7:
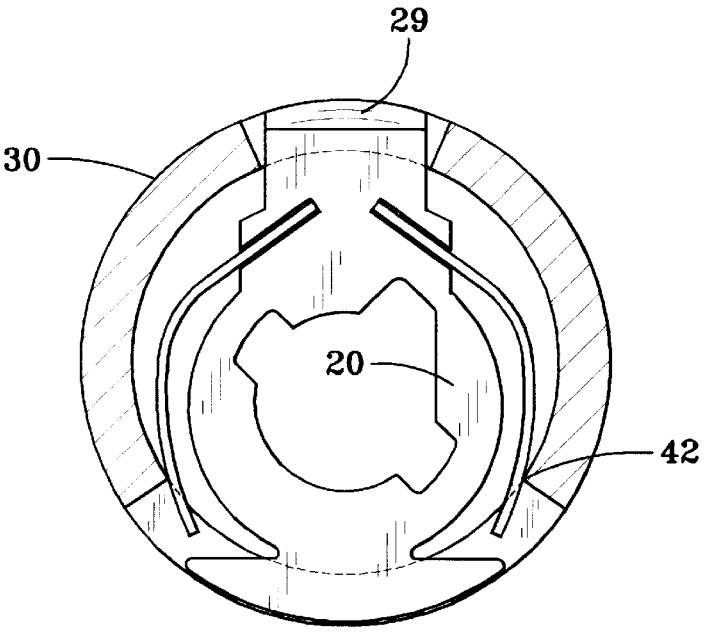
FIG. 7 is a cross-sectional view showing the handle catch depressed to allow removal of the handle.

Preferably, the base of the catch body 28 contains a plurality of relieved areas 26. As illustrated in FIGS. 6 and 7, these relieved areas 26 accommodate the free ends of the springs 22 during installation of the catch 20 into the spindle 30 (FIG. 6) and during installation or removal of the lever 10 when the catch 20 is depressed to release the catch tongue 29 from the lever 10 (FIG. 7). Note that in FIG. 6, the springs 22 are fully depressed during installation, but the long length of the springs 22 allows minimum deflection of the springs 22 and therefore low fatigue. FIG. 7 further shows a smooth line of contact between the springs 22 and the spindle 30. The high angle of contact 42 generates positive return pressure.

Preferably, the thickness of the springs 22 is no greater than the thickness of the handle catch 20, i.e., the springs lies within the same plane that the handle catch 20 lies in.

Having described the invention, what is claimed is:

1. A handle connector mechanism for connecting a door handle to a tubular sleeve comprising:

a connector mounted for movement radially of the tubular sleeve to a door handle connecting position, the connector comprising a flat plate-like member having a tongue extending in a first direction from the flat plate-like member and two separate spring members each fixedly attached to opposite sides of the flat plate-like member proximate the tongue and extending away from, in opposite directions, the flat plate-like member.

2. The handle connector mechanism according to claim 1, wherein the spring members extend in a second direction away from the first direction.

3. The handle connector mechanism according to claim 1, wherein each spring member comprises a straight portion and a curved portion, the straight portion being attached to the flat plate-like member.

4. The handle connector mechanism according to claim 1, wherein the flat plate-like member has a central opening extending therethrough.

5. The handle connector mechanism according to claim 1, further comprising:

means for accommodating spring compression.

6. The handle connector mechanism according to claim 5, wherein the means for accommodating spring compression comprises two relieved areas in an exterior surface of the flat plate-like member.

7. The handle connector mechanism according to claim 1, wherein the flat plate-like member has a front surface and a rear surface defining a thickness and the springs have a width such that the springs lie between a front plane in which the flat plate-like member front surface lies and a rear plane in which the flat plate-like member rear surface lies.

8. A handle connector mechanism for connecting a door handle to a tubular sleeve comprising:

a connector mounted for movement radially of the tubular sleeve to a door handle connecting position, the connector comprising a flat plate-like member having a tongue extending in a first direction from the flat plate-like member; two separate integral spring members each fixedly attached to opposite sides of the flat plate-like member proximate the tongue and extending away, in opposite directions, from the flat plate-like member; and two relieved areas in an exterior surface of the flat plate-like member.

9. For use in a door lock set incorporating a handle having an aperture therein and a spindle having an aperture therein, an integral handle catch comprising:

a flat member having a tongue extending therefrom;

two separate springs each fixedly attached to opposite sides of the flat member and extending away, in opposite directions, from the flat member; and means for accommodating spring compression.

10. In combination:

a door lock set handle having a first aperture therein;

a handle tubular sleeve having second and third apertures therein;

a handle catch within the handle tubular sleeve and comprising: a flat member having a tongue extending through the second aperture and engaging the first aperture; two separate springs each fixedly attached to opposite sides of the flat member extending away, in opposite directions, from the flat member and engaging the handle tubular sleeve; and means for accommodating compression of the springs.

* * * * *